US006778084B2

(12) United States Patent
Chang et al.

(10) Patent No.: US 6,778,084 B2
(45) Date of Patent: Aug. 17, 2004

(54) INTERACTIVE WIRELESS SURVEILLANCE AND SECURITY SYSTEM AND ASSOCIATED METHOD

(75) Inventors: Yu-Wen Chang, Rancho Palos Verdes, CA (US); William Traeger, Fayetteville, NC (US)

(73) Assignee: Chang Industry, Inc., La Verne, CA (US)

( * ) Notice: Subject to any disclaimer, the term of this patent is extended or adjusted under 35 U.S.C. 154(b) by 66 days.

(21) Appl. No.: 10/043,026

(22) Filed: Jan. 9, 2002

(65) Prior Publication Data

US 2003/0128113 A1 Jul. 10, 2003

(51) Int. Cl.[7] ..... G08B 13/00

(52) U.S. Cl. ..... 340/541; 340/539.1; 340/506; 340/825.49; 340/504

(58) Field of Search ..... 340/541, 539.1, 340/506, 825.49, 825.69, 825.72, 825.71, 825.22, 539.25, 539.14, 504

(56) References Cited

U.S. PATENT DOCUMENTS 3,672,269 A * 6/1972 Tabankin ..... 369/427
4,375,637 A 3/1983 Desjardins
4,651,143 A 3/1987 Yamanaka
4,962,473 A 10/1990 Crain
5,027,104 A 6/1991 Reid
5,117,217 A 5/1992 Nykerk
5,223,844 A * 6/1993 Mansell et al. ..... 340/825.49
5,268,668 A * 12/1993 Berube ..... 340/505
5,311,166 A 5/1994 Frye
5,319,698 A 6/1994 Glidewell et al.
5,334,974 A * 8/1994 Simms et al. ..... 340/990
5,345,549 A 9/1994 Appel et al.
5,412,708 A 5/1995 Katz
5,553,609 A 9/1996 Chen et al.
5,559,496 A 9/1996 Dubats
5,565,855 A * 10/1996 Knibbe ..... 340/825.06
5,581,236 A 12/1996 Hoseit et al.
5,628,050 A 5/1997 McGraw et al.
5,629,687 A 5/1997 Sutton et al.
5,736,927 A 4/1998 Stebbins et al.
5,781,108 A 7/1998 Jacob et al.
5,793,419 A 8/1998 Fraley
6,020,825 A 2/2000 Chansky et al.
6,091,327 A * 7/2000 Heed et al. ..... 340/506
6,166,632 A 12/2000 Chen
6,211,907 B1 * 4/2001 Scaman et al. ..... 348/148
6,559,769 B2 * 5/2003 Anthony et al. ..... 340/574

* cited by examiner

*Primary Examiner*—Jeffery Hofsass
*Assistant Examiner*—Daniel Previl
(74) *Attorney, Agent, or Firm*—Alston & Bird LLP

(57) ABSTRACT

A surveillance and security system, adapted to be applicable to a premises, is provided. The system comprises a system component installed on and capable of interacting with the premises. A wireless command unit is configured to communicate with and control the system component from a remotely-disposed location with respect thereto. The system component is configured to perform an examination of the premises and to send a corresponding surveillance signal to the command unit. The command unit is configured to send a broadcast signal to the system component for a corresponding broadcast to the premises. The command unit is thereby capable of two-way audio/video communication with the system component so as to provide remote surveillance and security for the premises. An associated method is also provided.

23 Claims, 2 Drawing Sheets

INTERACTIVE WIRELESS SURVEILLANCE AND SECURITY SYSTEM AND ASSOCIATED METHOD

FIELD OF THE INVENTION

The present invention relates to surveillance and security systems and, more particularly, to an interactive wireless surveillance and security system, wherein a portable command unit is capable of two-way audiovisual communication with and controlling of a portion of the surveillance and security system installed at a remote location.

BACKGROUND OF THE INVENTION

The prevalence of crime in any locale may urge a property owner in that locale to install a security system on that property, wherein such property may comprise, for example, a house, a commercial building, a car, a boat, or the like. However, typically available systems for providing surveillance and/or security for such property may have limitations which may not be desirable for the property owner. For example, commercially available security devices may be installed on the property, but such devices may only provide for local alerts of security breaches. That is, if security of the property is breached, a siren or alarm on the property is sounded so as to attempt to scare off the perpetrator or draw bystander attention to the property being breached. However, such devices may sometimes be readily defeated or, in areas where such devices are commonplace, may be ignored by bystanders altogether. Further, in remote areas, the alarm or siren may not be heard by anyone at all. In addition, if an alarm is activated, the cause or perpetrator may remain unknown since the offensive event is typically not recorded. As such, a local system may only be effective if the property owner is within the vicinity and is able to take immediate action.

Alternatively, commercial security services may be contracted to monitor the security devices from a central location and to dispatch emergency personnel in the event that an alarm is triggered on the property. However, such services may require costly monitoring agreements, emergency personnel may not respond in a timely manner, and the property owner may not be available or timely notified of the alarm event. As such, the property owner may be dissatisfied with the extent of protection available with such a system since the ability of someone to take immediate action in the event of an alarm is also limited. Thus, there exists a need for a surveillance and security system for a premises or property capable of providing an expedited alarm notification to the property owner, regardless of the proximity of the owner with respect to the property, while providing sufficient detail to the property owner regarding the nature of the alarm and the related events transpiring at the property.

In some instances, the event or person causing the alarm at the property is known to the property owner, or may be the property owner himself, wherein the activation of the alarm is inadvertent or accidental. The resulting false alarm may unnecessarily disturb bystanders and/or neighbors and may serve to further the indifference of bystanders to such alarms. If the property owner is not in the area and able to reset or cancel the alarm, unnecessary central monitoring services may be used and emergency response units dispatched to the property, thereby possibly resulting in costly charges to the property owner and waste of limited emergency response resources. Thus, there exists a need for a surveillance and security system capable of allowing the property owner to be timely notified of an alarm event on the property while allowing the property to be surveyed with sufficient detail to allow the nature of the alarm to be identified and addressed.

Still further, even though the property has a surveillance and security system installed thereon, the nature of a threat may not necessarily be against the property itself. For example, the property owner may return to the property to find that a perpetrator is waiting to accost the property owner himself and has no interest in the protected property. Typically, the surveillance and security system would not discern such a situation as an alarm event since, for example, the situation may be outside the scope of protection or the owner may have already disabled the system. Thus, there exists a need for a surveillance and security system capable of allowing the property owner to assess the security status of the property prior to approaching that property. In some instances, it may also be desirable for such a system to provide the property owner with a periodic status update of the property or allow the property owner to conduct an on-demand assessment of the property.

SUMMARY OF THE INVENTION

The above and other needs are met by the present invention which, in one embodiment, provides a surveillance and security system adapted to be applicable to a premises. The system comprises a system component installed on and capable of interacting with the premises. A wireless command unit is configured to communicate with and control the system component from a remotely-disposed location with respect thereto. The system component is configured to perform an examination of the premises and to send a corresponding surveillance signal to the command unit. The command unit is configured to send a broadcast signal to the system component for a corresponding broadcast to the premises. The command unit is thereby capable of two-way communication with the system component so as to provide remote surveillance and security for the premises.

Another advantageous aspect of the present invention comprises a method of providing surveillance and security with a surveillance and security system, comprising a system component and a wireless command unit, adapted for application to a premises. According to such a method, a surveillance signal is sent from the system component installed on and capable of interacting with the premises to the wireless command unit remotely disposed with respect thereto. The command unit is configured to provide at least one of an audio indicia and a video indicia of the surveillance signal. In addition, at least one of a control signal and a broadcast signal may be sent from the command unit to the system component. The system component is responsive to the control signal and is configured to provide at least one of an audio indicia and a video indicia of the broadcast signal to the premises. The system component and the command unit thereby cooperate to provide two-way communication therebetween so as to facilitate remote surveillance and security for the premises.

Accordingly, embodiments of the present invention provide a surveillance and security system for a premises or property capable of providing an expedited alarm notification to the property owner, regardless of the proximity of the owner with respect to the property, while providing sufficient detail to the property owner regarding the nature of the alarm and the related events transpiring at the property. Further, embodiments of the present invention allow the property to be surveyed with sufficient detail to allow the nature of the alarm to be immediately identified and addressed by the property owner. In addition, embodiments of the present invention are capable of allowing the property owner to assess the security status of the property prior to approaching that property, for example, as a periodic status update of the property provided to the property owner or by allowing the property owner to conduct an on-demand assessment of the property. Accordingly, embodiments of the present invention provide significant advantages as detailed herein.

BRIEF DESCRIPTION OF THE DRAWINGS

Figure 1:
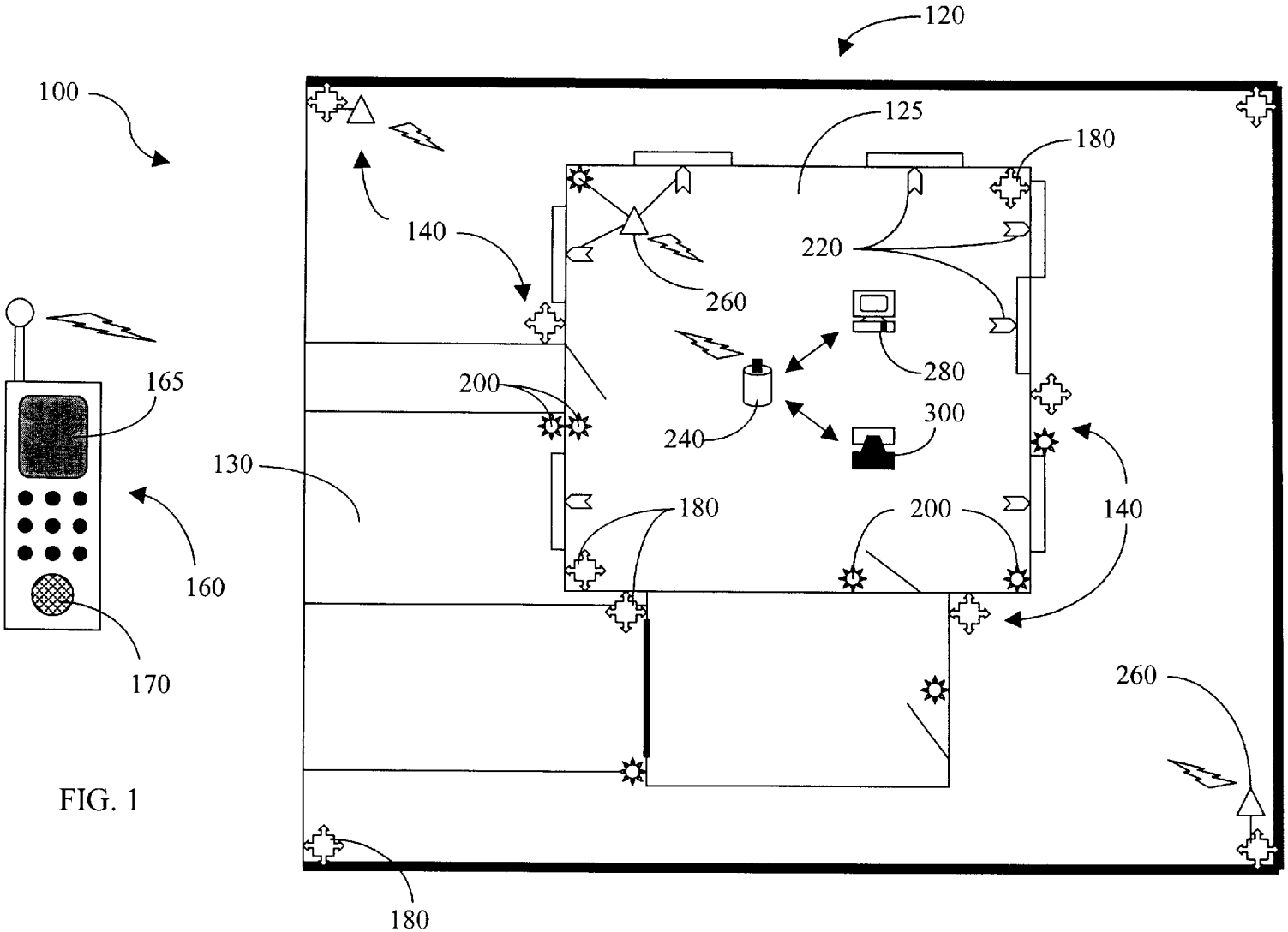

Having thus described the invention in general terms, reference will now be made to the accompanying drawings, which are not necessarily drawn to scale, and wherein:

FIG. 1 is a schematic plan view of a surveillance and security system according to one embodiment of the present invention installed on a premises and configured to interact therewith.

Figure 2:
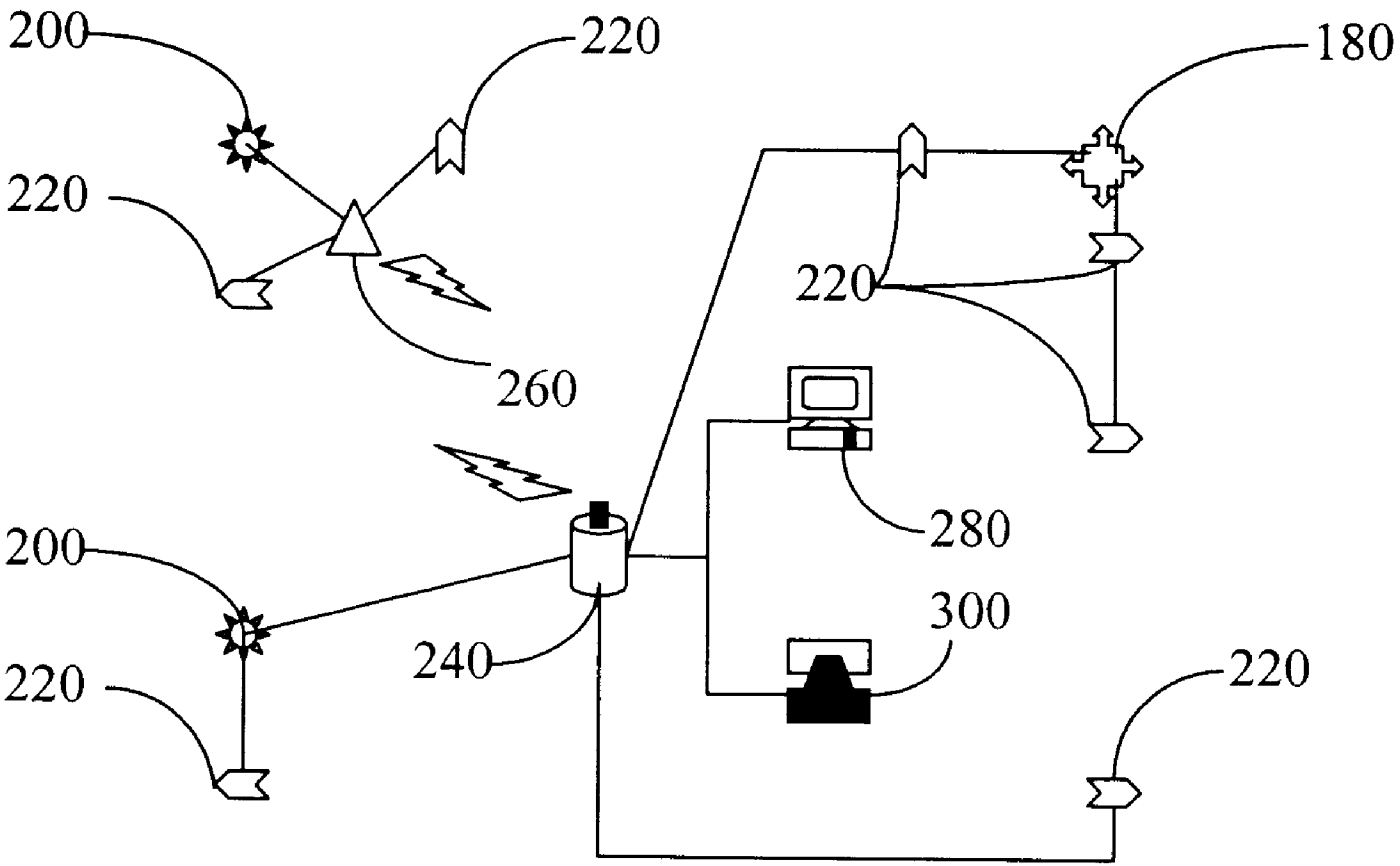

FIG. 2 is a schematic illustration of connections between system components on a premises according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 schematically illustrates a surveillance and security system 100 according to one embodiment of the present invention. Though the present invention is described herein in terms of an exemplary applicability to a premises 120, such as a residential dwelling, one skilled in the art will appreciate that the described system 100 is equally applicable to, for example, a commercial building, an automobile, a boat, an airplane, or any other premises which would benefit from having surveillance and security applied thereto. One skilled in the art will also appreciate that the components of the system 100 may also be designed, built, arranged, made operable, or otherwise configured depending on, for example, the property being protected and the nature of the desired protection. Note also that the nature of the system components 140 may be extended, in appropriate circumstances, to smoke detectors or sprinkler systems in a building, bilge pump or shore power connections in a boat, or the like, again depending on the nature of the surveillance and the level and type of protection being sought.

Accordingly, the system 100 according to one embodiment of the present invention may comprise one or more system components 140 configured to be communicable with and/or controlled by a wireless command unit 160. For a premises 120, such as a residential dwelling 125 and associated property 130 as shown in FIG. 1, the system components 140 may comprise, for example, one or more cameras 180 capable of capturing video and/or audio data, one or more audio devices 200 capable of capturing and/or broadcasting audio data, and one or more intrusion devices 220 capable of detecting any intrusion onto the premises 120. Such intrusion devices 220 may comprise, for example, glass breakage sensors or other shock sensors, motion detectors, contact switches, proximity or alignment sensors, or the like, depending on the particular application and the extent of the desired protection. One skilled in the art will appreciate that such system components 140 are placed and installed about the premises 120 so as to provide optimum surveillance and security capabilities while being, for example, inconspicuous or resistant to disablement.

The system components 140 may be interconnected with, for instance, appropriate coaxial cable (not shown) or other suitable wiring, and terminated at a master terminal box 240 on the premises 120. One skilled in the art will appreciate, however, that the system components 140 may be interconnected and/or connected to the master terminal box 240 in a variety of manners. For example, each system component 140 may be wired directly to the master terminal box 240 or several or all of the system components 140 may be interconnected prior to being wired to the master terminal box 240. In other instances, groups of system components 140 may be connected to a wireless transmitter and/or receiver device 260 configured for wireless communication with the master terminal box 240. Such configurations are shown, for example, in FIG. 2.

The master terminal box 240 is capable of communicating with the command unit 160 through a wireless link. More particularly, and as a very important advantageous aspect of the present invention, the master terminal box 240 is capable of two-way wireless audio and video communication with the command unit 160. Such operability may be provided by, for example, FCC compliant wireless transmitter/receiver units incorporated into each of the master terminal box 240 and the command unit 160. In other instances, the master terminal box 240 may be comprise or be connected to a telephone device 280 and the command unit 160 may comprise or be interfaced with a cellular telephone, so as to provide two-way wireless communication capabilities. In still other instances, the master terminal box 240 may comprise or be connected to a computer device 300 capable of two-way wireless communication with the command unit 160 comprising, for example, a smart phone, over a wireless Internet.

According to embodiments of the present invention, the command unit 160 is capable of wireless two-way communication with the master terminal box 240 such that the command unit 160 is portable and capable of being transported with the premises owner, on or off the premises 120, and even at remote distances therefrom. For size considerations or transportation concerns, the command unit 160 is as compact as possible while incorporating the desired functionality as described herein. The command unit 160 is preferably configured so as to be capable of receiving audio and video data from the system components 140 on the premises 120 via the master terminal box 240 and is capable of displaying or otherwise broadcasting this data so as to provide an indication of the data to the owner in a coherent form. For example, the command unit 160 may include an LCD screen 165, or may be connected with a video display device, or the like, for displaying the video data and a speaker 170, or audio output jack connectable to a speaker device, or the like, for broadcasting the audio data. In some instances, the command unit 160 may also include, for example, a video camera and/or a microphone for receiving video and/or audio data from the owner for transmission to the premises 120. Note also that the command unit 160 may, in some instances, be capable of other wireless functions such as, for example, cellular telephone or wireless Internet, or may be interfaced with other equipment having such capabilities so as to provide the appropriate functionality as discussed herein.

The video data capabilities between the command unit 160 and the premises 120 may also be helpful, for example, in reducing false alarm events by allowing the owner to identify the perpetrator or entity responsible for an alarm event prior to notifying law enforcement or other emergency response personnel. In other instances, the video and/or audio capabilities may provide a discriminator function for the system 100. For example, the video portions of the system 100 may be configured to recognize a human form and trigger an alarm event, or notify authorities, when that human form is recognized, as opposed to, for instance, a dog or a cat. Similarly, the audio portions of the system 100 may be configured to recognize a human voice, as opposed to, for example, a dog's bark or a cat's meow, and to thus prompt the system 100 to act accordingly.

The command unit 160 is also preferably configured so as to be capable of transmitting or otherwise sending communications to the master terminal box 240 or the system components 140 on the premises. For example, each system component 140 (and the master terminal box 240) may have a unique communication identifier so as to allow the command unit 160 to individually communicate with each system component 140 or the master terminal box 240. Such functionality may comprise, for instance, a command signal initiating a simple on/off communication with a system component 140. Where the system component 140 comprises a camera, the command signal may direct the camera to pan, tilt, zoom, focus, or other perform other camera functions. Further, in instances where the system component 140 comprises a microphone, speaker, or other audio device, the command signal may direct the audio device to increase or decrease a volume level, receive audio data from the premises, broadcast audio data to the premises, or the like. One skilled in the art will thus appreciate that the functionality of the command unit 160 may be appropriately adapted and configured in correspondence to the nature of the system components, the property being protected, and the level of protection being sought.

Note also that, in some instances, the system components 140, the master terminal box 240, and/or the command unit 160 may be configured to record audio and/or video data gathered from the premises 120 by the system components 140, as well as audio and/or video data or command signals sent to the premises 120 by the command unit 160. Accordingly, the recording functionality may implemented in any of the system components 140, the master terminal box 240, and the command unit 160 so as to provide for subsequent selective playback of the details surrounding a selective or periodic surveillance of the premises or a particular alarm event. For example, the recordation of an event may be helpful in identifying a perpetrator or as evidence in a court of law.

Thus, embodiments of the present invention, as detailed herein, facilitates two-way audio and/or video communication between the owner of a property or premises and the premises 120 via a handheld command unit 160. In some instances, the system components 140 installed on the premises 120 may be configured to recognize changes in the state of the premises 120 as an alarm event and thereby notify the owner via the command unit 160 while also notifying the authorities. However, by transmitting audio and/or video data from the premises 120 to the command unit 160, the owner is able to identify the nature of the alarm event, or the nature of the alarm event may be automatically identified by the system 100, and a decision can be made whether to notify the authorities, thereby reducing false alarms. Still further, upon receiving the audio and/or video data from the premises 120, the owner may choose to send video and/or audio data in response. For example, the owner may send an audio and/or video warning to the premises 120 that may then be broadcast to the perpetrator from the appropriate system component 140, wherein the warning may indicate to the perpetrator, for example, that he has been identified, the authorities are en route, or the owner is within the vicinity of the premises 120. The owner may even, in some instances, have a two-way audiovisual conversation with the perpetrator. In simpler instances, the warning may simply ask a neighborhood child to stay off the lawn.

Many other functions are also possible within the spirit and scope of the present invention. For example, if the owner is within, for example, the house 125 on the premises 120, the command unit 160 may be used for surveillance of the property 130 so as to provide the owner with, for instance, advanced warnings of incoming threats. In still other instances, the owner may use the command unit 160 for surveillance of the premises 120 prior to arriving at the premises 120, the surveillance thereby allowing the owner to, for example, determine if the premises are safe for approach or entry by making sure that a perpetrator is not lying in wait. Note also that the functionality described herein in relation to embodiments of the present invention may include a service provider or other intermediary providing such a surveillance and security system 100 to the owner of the premises. That is, a service provider may provide such a surveillance and security system 100 to the premises owner as a stand-alone system, wherein the operability of the system 100, such as communication between the command unit 160 and the master terminal box 240, may only be available over a limited subscription period. The service provider, also over a limited subscription period, may provide, for example, monitoring of one or two way communication between the command unit 160 and the master terminal box 240 on the premises 120, in addition to allowing the above-described functionality of the system 100 with respect to the owner, or any other appropriate combinations of components and services as described herein within the spirit and scope of the present invention.

Thus, embodiments of the present invention provide a surveillance and security system for a premises or property capable of providing an expedited alarm notification to the property owner, regardless of the proximity of the owner with respect to the property, while providing sufficient detail to the property owner regarding the nature of the alarm and the related events transpiring at the property. Further, embodiments of the present invention allow the property to be surveyed with sufficient detail to allow the nature of the alarm to be immediately identified and addressed by the property owner. In addition, embodiments of the present invention are capable of allowing the property owner to assess the security status of the property prior to approaching that property, for example, as a periodic status update of the property provided to the property owner or by allowing the property owner to conduct an on-demand assessment of the property. Accordingly, embodiments of the present invention most advantageously allow the owner of a property or premises to implement surveillance and security for the property while having a handheld command unit for facilitating instant notification of alarm events, as well as two-way audio and/or video communication between the owner and the premises.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A surveillance and security system adapted to be applicable to a premises, said system comprising:

a surveillance component installed on the premises;

a broadcast component installed on the premises; and a wireless command unit adapted to interact with an operator and configured to communicate with and control the components on the premises from a remotely-disposed location with respect thereto, the surveillance component being configured to capture a representation of the premises and to send a corresponding surveillance signal to the command unit, the command unit being responsive to the surveillance signal to provide an audiovisual reproduction of the premises representation to the operator, the command unit also being configured to allow the operator to send a message signal to the broadcast component and thereby direct the broadcast component to broadcast an audiovisual communication and, corresponding to the message signal, to the premises, the command unit thereby being capable of two-way audiovisual communication with the premises, via the components, so as to provide remote interactive surveillance and security therefor.

2. A system according to claim 1 wherein the command unit is further configured to transmit a command signal to one of the components for controlling that component.

3. A system according to claim 1 wherein the surveillance signal comprises an audiovisual signal.

4. A system according to claim 1 further comprising at least one of an intrusion detection device and a hazard detection device, each device being configured to sense a change in the premises and to actuate the surveillance component to capture the representation of the premises iii response thereto.

5. A system according to claim 1 wherein the surveillance component further comprises at least one of a video capturing device and an audio capturing device for capturing the representation of the premises and the broadcast component further comprises at least one of a video broadcast device and an audio broadcast device for broadcasting to the message signal to the premises.

6. A system according 1 claim wherein the surveillance component is further configured to perform a surveillance of the premises at a predetermined interval and send a corresponding surveillance signal back to the command unit to thereby provide a periodic check function.

7. A system according to claim 1 wherein the surveillance component is further configured to automatically sense a change in the premises and to send a corresponding surveillance signal to the command unit in response thereto.

8. A system according to claim 7 further comprising a discriminator operably engaged with the surveillance component and configured to apply a threshold criteria to the change in the premises so as to prevent a surveillance signal corresponding to a sub-threshold change in the premises from being sent to the command unit.

9. A system according to claim 7 wherein the command unit is configured to selectively send a broadcast signal to the broadcast component in response to receiving the surveillance signal corresponding to the change in the premises thereby directing the broadcast component to broadcast at least one of a visual communication and an audible communication, corresponding to the broadcast signal, to the premises.

10. A system according to claim 1 wherein the command unit is configured to send a command signal to the surveillance component when selectively actuated, the surveillance component being responsive to the command signal so as to send a surveillance signal hack to the command unit and thereby provide an on-demand check function.

11. A system according to claim 1 wherein the command unit is further configured to send a broadcast signal to the broadcast component, to be broadcast thereby as at least one of a visual communication and an audible communication, when the command unit is approaching the premises and within a predetermined proximity thereof.

12. A system according to claim 1 further comprising a plurality of surveillance components and broadcast components, each component being configured to be individually communicable with the command unit and comprising a unique identifier, the command unit being further configured to communicate with a selected component according to the respective identifier thereof.

13. A system according to claim 1 wherein the surveillance component is configured to record the surveillance signal so as to allow subsequent selective playback.

14. A system according to claim 1 wherein the command unit is configured to the interfaced with a computer device.

15. A method of providing surveillance and security with a surveillance and security system comprising a surveillance component a broadcast component and a wireless command unit, the system being adapted for application to a premises and to be capable of interacting with an operator, said method comprising:

capturing a representation of the premises with the surveillance component installed on the premises;

sending a surveillance signal corresponding to the premises representation from the surveillance component to the wireless command unit remotely disposed with respect thereto;

providing an audiovisual reproduction of the premises representation to the operator with the command unit in response to the surveillance signal; and allowing the operator to send a message signal to the broadcast component installed on the premises via the command unit and thereby direct the broadcast component to broadcast an audiovisual communication, corresponding to the message signal, to the premises, the components and the command unit thereby cooperating to provide two-way audiovisual communication between the command unit and the premises so as to facilitate remote interactive surveillance and security for the premises.

16. A method according to claim 15 further comprising recording the surveillance signal with the surveillance component in such a manner as to facilitate subsequent selective playback.

17. A method according to claim 15 wherein the system further comprises a plurality of surveillance components and broadcast components, with each component having a unique identifier, and the method further comprises individually communicating between a selected component and the command unit according to the respective identifier of the selected component.

18. A method according to claim 15 further comprising performing a surveillance or the premises at a predetermined interval, prior to sending a corresponding surveillance signal to the command unit, so as to provide a periodic check function.

19. A method according to claim 15 further comprising automatically sensing a change in the premises prior to sending a corresponding surveillance signal to the command unit.

20. A method according to claim 19 comprising applying a threshold criteria to the sensed change in the premises so as to prevent a surveillance signal corresponding to a sub-threshold change in the premises from being sent to the command unit.

21. A method according to claim 19 further comprising selectively sending a broadcast signal to the broadcast coinponewfl in response to receiving the surveillance signal corresponding to the change in the premises, and thereby directing the broadcast component to broadcast at least one of a visual communication and an audible communication, corresponding to the broadcast signal, to the promises.

22. A method according to claim 15 further comprising selectively sending a command signal from the command unit to the surveillance component so as to actuate the surveillance component to perform a surveillance of the premises and to send a corresponding surveillance signal back to the command unit so as to provide an on-demand check function.

23. A method according to claim 15 further comprising sending a broadcast signal to the broadcast component, to be broadcast thereby as at least one of a visual communication and an audible communication, when the command unit is approaching the premises and within a predetermined proximity thereof.

* * * * *

UNITED STATES PATENT AND TRADEMARK OFFICE

CERTIFICATE OF CORRECTION

PATENT NO. : 6,778,084 B2
DATED : August 17, 2004
INVENTOR(S) : Chang et al.

It is certified that error appears in the above-identified patent and that said Letters Patent is hereby corrected as shown below:

Column 7,
Line 27, remove the word "and" following the word "communication";
Line 42, "iii" should read -- in --;
Line 49, remove the word "to" following "broadcasting";
Line 51, "according 1 claim" should read -- according to claim 1 --.

Column 8,
Line 11, "hack" should read -- back --;
Line 29, "the" should read -- be --.

Column 9,
Line 15, "coinponewfl" should read -- component --.

Signed and Sealed this

Nineteenth Day of October, 2004

JON W. DUDAS
*Director of the United States Patent and Trademark Office*